US007988841B2

(12) United States Patent
Scurati et al.

(10) Patent No.: US 7,988,841 B2
(45) Date of Patent: Aug. 2, 2011

(54) TREATMENT OF BIOLOGICAL SAMPLES USING DIELECTROPHORESIS

(75) Inventors: Mario Scurati, Milan (IT); Torsten Mueller, Berlin (DE); Thomas Schnelle, Berlin (DE)

(73) Assignee: STMicroelectronics S.r.l., Agrate Brianza (IT)

( * ) Notice: Subject to any disclaimer, the term of this patent is extended or adjusted under 35 U.S.C. 154(b) by 1008 days.

(21) Appl. No.: 11/531,679

(22) Filed: Sep. 13, 2006

(65) Prior Publication Data

US 2007/0125650 A1 Jun. 7, 2007

(30) Foreign Application Priority Data

Sep. 14, 2005 (EP) ..... 05108445

(51) Int. Cl.
*B03C 5/02* (2006.01)

(52) U.S. Cl. ..... 204/547; 204/643

(58) Field of Classification Search ..... 204/547, 204/643

See application file for complete search history.

(56) References Cited

U.S. PATENT DOCUMENTS

| | | | |
|---|---|---|---|
| 6,071,394 | A | 6/2000 | Cheng et al. |
| 6,235,471 | B1 | 5/2001 | Knapp et al. |
| 6,280,590 | B1 | 8/2001 | Cheng et al. |
| 6,403,338 | B1 | 6/2002 | Knapp et al. |
| 6,727,451 | B1 | 4/2004 | Fuhr et al. |
| 6,749,736 | B1 | 6/2004 | Fuhr et al. |
| 6,783,647 | B2 | 8/2004 | Culbertson et al. |
| 2002/0036142 | A1 | 3/2002 | Gascoyne et al. |
| 2002/0088712 | A1 | 7/2002 | Miles |
| 2004/0011650 | A1 | 1/2004 | Zenhausern et al. |

FOREIGN PATENT DOCUMENTS

| | | |
|---|---|---|
| EP | 1403383 | 3/2004 |
| WO | WO9322058 | 11/1993 |

OTHER PUBLICATIONS

Bard et al., Electrochemical detection of single molecules. Acc. Chem. Res. 29:572-8, (1996).

Bashir, R., Electronic detection of bio-species on a chip. National Nanofabrication Users Network, Cornell Nanoscale Facility, CNF Project # 827-00, p. 40.

Cheng et al., Preparation and hybridization analysis of DNA/RNA from *E. coil* on microfabricated bioelectric chips. Nat Biotechnol. 16:541-6, (1998).

Derouich-Guergour et al., A lab-on-chip for cell sorting and manipulation based on dielectrophoresis; effect of beads on cell levitation. Brochure, Minatec 2003 Applications, Inserm, Grenoble, France.

Erickson et al., Integrated microfluidic devices—Review. Analytica Chimica Acta. 507:11-26, (2004).

(Continued)

*Primary Examiner* — Jeffrey T Barton
*Assistant Examiner* — J. Christopher Ball
(74) *Attorney, Agent, or Firm* — Boulware & Valoir

(57) ABSTRACT

A plurality of planar electrodes (5) in a microchannel (4) is used for separation, lysis and PCR in a chip (10). Cells from a sample are brought to the electrodes (5). Depending on sample properties, phase pattern, frequency and voltage of the electrodes and flow velocity are chosen to trap target cells (16) using DEP, whereas the majority of unwanted cells (17) flushes through. After separation the target cell (16) are lysed while still trapped. Lysis is carried out by applying RF pulses and/or thermally so as to change the dielectric properties of the trapped cells. After lysis, the target cells (16) are amplified within the microchannel (4), so as to obtain separation, lysis and PCR on same chip (1).

25 Claims, 9 Drawing Sheets

OTHER PUBLICATIONS

Gascoyne et al., Dielectrophoresis-based sample handling in general-purpose programmable diagnostic instruments. Proceedings of the IEEE. 92:22-42, (2004).

Gascoyne et al., Microfluidic approaches to malaria detection. Acta Tropica. 89:357-69, (2004).

Hofmann et al., Passive DNA sensor with gold electrodes fabricated in a CMOS backend process. Infineon Technologies, Munich, Germany, (2002).

Holmes et al., Cell positioning and sorting using dielectrophoresis. EU Cells & Materials. 4:120-2, (2002).

Holmes et al., Microdevices for dielectrophoretic flow-through cell separation. IEEE Engineering in Medicine and Biology Magazine. Nov./Dec. 2003, pp. 85-90.

Huang et al., Universal platform for developing an integrated biochip or micro-TAS based on electrokinetics. Tamkang Journal of Science and Engineering. 7:107-10, (2004).

Karolis et al., Differential effects of cholesterol and oxidized-cholesterol in egg lecithin bilayers. Biochimica et Biophysica Acta. 1368:247-55, (1998).

Lapizco-Encinas et al, Insulator-based dielectrophoresis for the selective concentration and separation of live bacteria in water. Electrophoresis. 25:1695-1704, (2004).

Lee et al., A micro cell lysis device. Caltech Micromachining Laboratory, California Institute of Technology, Pasadena, California, USA (1999).

Malnar et al., Laboratory-on-a-chip device for DNA separation detection in medical diagnostics. www.brunel.ac.uk, ESIT Research Group, Brunel University, Uxbridge, Middlesex, United Kingdom.

Medoro et al., A lab-on-a-chip for cell separation based on the moving-cages approach. Silicon Biosystems, Bologna, Italy (2002).

Muller et al., Reversible electropermeabilization of mammalian cells by high-intensity, ultra-short pulses of submicrosecond duration. J. Membrane Biol. 184:161-70, (2001).

Schnelle et al., Paired microelectrode system: dielectrophoretic particle sorting and force calibration. Journal of Electrostatics. 47:121-32, (1999).

Wang et al., Cell separation by dielectrophoretic field-flow-fractionation. Anal Chem. 72:832-9. (2000).

Xu et al., Functional biochips for cell and molecular manipulation. AVIVA Biosciences Corporation, San Diego, California.

Anonymous, Dielectrophoresis. Web article, www.informatics.bangor.ac.uk./~burt/dep/dep.htm, University of Bangor Wales, Bangor, Gwynedd, United Kingdom.

$$F_x^{max}\Big|_{y=a/2} = \frac{27\pi^2\varepsilon_1 \mathrm{Re}[f_{CM}]}{32}(R/a)^3 U^2$$

TREATMENT OF BIOLOGICAL SAMPLES USING DIELECTROPHORESIS

CROSS-REFERENCE TO RELATED APPLICATIONS

This application claims priority to EP 05108445.7, filed Sep. 14, 2005, and is incorporated in its entirety herein by reference.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

The present invention relates to a method and device for the treatment of biological samples using dielectrophoresis.

As is known, dielectrophoresis (DEP) is increasingly used in microchips to manipulate, identify, characterize and purify biological and artificial particles. DEP exploits frequency dependent differences in polarizability between the particles to be treated and the surrounding liquid that occur when RF (Radio Frequency) electric fields are applied thereto via microelectrodes.

In case of biological particles, to which reference is made without losing generality, the microelectrodes can additionally be used to apply DC (Direct Current) voltage pulses of high amplitude (of the order of 100 V) for short times (of the order of microseconds) to destroy membrane integrity of dielectrophoretically captured cells, for later PCR-Polymerase Chain Reaction (see, e.g., U.S. Pat. No. 6,280,590). On the other hand, solid-phase PCR (on-chip PCR) has been developed for later detection of products, e.g. in microarray format already commercially available [see, e.g., vbc-genomics.com/on_chip_pcr.html and WO-A-93/22058).

The theoretical background of DEP will be described herein below.

If a time-periodic electric field is applied to a dielectric particle, the particle is subject to a dielectrophoretic force that is a function of the dielectric polarizability of the particle in the liquid, that is the difference between the tendencies of particle and of the liquid to respond to the applied electrical field. In particular, for a spherical dielectric particle of radius R subject to an electric time-periodic field E having a root-mean-square value $\vec{E}_{rms}$ and angular frequency ω, the particle is subject to a dielectrophoretic force whose time averaged value $\langle\vec{F}_d\rangle_{av}$ can be expressed using the dipole approximation as:

$$\langle\vec{F}_d\rangle_{av} = 2\pi\varepsilon_1 R^3 Re[f_{CM}] * \nabla\vec{E}_{rms}^2 \tag{1}$$

wherein $\in_l$ is the liquid permittivity and $f_{CM}$ represents the above dielectric polarizability tendency, called the Clausius-Mossotti factor (see M. P. Hughes, *Nanoelectromechanics in Engineering and Biology.* 2002: CRC Press, Boca Raton, Fla. 322 pp). For a homogeneous sphere suspended in a liquid, the Clausius-Mossotti factor has been found to be:

$$f_{CM} = \frac{\tilde{\sigma}_p - \tilde{\sigma}_l}{\tilde{\sigma}_p + 2\tilde{\sigma}_l} \text{ with } \tilde{\sigma} = \sigma + i\omega\varepsilon \tag{2}$$

wherein σ represents the conductivity (the index p referring to the particle and the index l referring to the liquid) and ∈ is the absolute permittivity.

For a more complex particle, the effective particle conductivity σ has to be used; e.g., in case of a particle with spherical shape, formed by a shell (membrane) enclosing a different material in the interior, it reads:

$$\tilde{\sigma}_p = \tilde{\sigma}_m \left\{ \frac{a^3 + 2\left(\frac{\tilde{\sigma}_i - \tilde{\sigma}_m}{\tilde{\sigma}_i + 2\tilde{\sigma}_m}\right)}{a^3 - \left(\frac{\tilde{\sigma}_i - \tilde{\sigma}_m}{\tilde{\sigma}_i + 2\tilde{\sigma}_m}\right)} \right\} \tag{3}$$

wherein the indices i and m refer to particle interior and membrane, respectively, and $$a = \frac{R}{R-h}$$

for a membrane with thickness h. R is again the particle radius.

FIG. 1 illustrates the relative dielectrophoretic force for lymphocytes (continuous line) and erythrocytes (broken lines) for media having three different conductivities. The dielectric spectra ($f_{CM}$*$R^2$) shifts to higher frequencies as conductivities rise and particles switch between positive DEP (pDEP, where the particles are attracted towards the electrodes), and negative DEP (nDEP, where the particles are repelled from the electrodes).

It has been already demonstrated (see Schnelle et al., "Paired microelectrode system: dielectrophoretic particle sorting and force calibration", J. Electrostatics, 47/3, 121-132, 1999) that cells can be separated if they present different dielectrophoretic behaviour e.g. through different composition and/or size and/or shape, using equilibrium of flow (scaling with particle radius R) and DEP forces between face to face mounted electrode strips.

If a particle showing nDEP at preset conditions is brought by streaming near an energised electrode pair, it is lifted to the central plane, experiencing repulsion forces from both electrodes. FIG. 2 shows both equipotential and current lines between the electrode pair from the analytic solution for a semi-infinite plate capacitor.

Application of electric fields to conductive solutions is accompanied by heating. The balance equation for the temperature T reads:

$$\rho c_p\left(\vec{v}\cdot\nabla T + \frac{\partial}{\partial t}T\right) = \lambda\Delta T + \sigma E_{rms}^2 \tag{4}$$

wherein ρ is the liquid density, $c_p$ is the specific heat, λ is the thermal conductivity and ν is the velocity of the liquid. For example, for water, $c_p$=4.18 kJ/(kg K), λ~0.6 W/(m K). If $\rho c_p v\alpha \ll 1$, the flow term in eq. 4 can be neglected (v<<4 mm/s in a channel with a height a=40 μm) and eq. 4 can be simplified to:

$$\rho c_p \frac{\partial}{\partial t} T = \lambda \Delta T + \sigma E_{rms}^2 \quad (5)$$

The time constant $t_d$ for thermal equilibrium can be derived to be:

$$t_d = \rho c_p \alpha^2 / \lambda \quad (6)$$

which gives, for an aqueous solution and a=40 μm, $t_d \cong 1$ ms.

The stationary version of eq. 5 reads:

$$0 = \lambda \Delta T + \sigma E^2 \quad (7)$$

According to a dimensional analysis, this gives an order of magnitude estimate for the temperature rise of:

$$\partial T = \sigma U_{rms}^2 / \lambda \quad (8)$$

wherein $U_{rms}$ is the root mean square voltage applied between the electrodes. For an aqueous solutions with σ=1 S/m and a root mean square voltage $U_{rms}$=5 V, eq. (8) results in T≅42° C. Thus physiological solutions can be heated up to boiling using moderate voltages. The absolute value of temperature depends on the electric field distribution and geometry, and can be usually obtained using numerical procedures. Quantitatively temperature rise is given by:

$$\partial T = \gamma \sigma U_{rms}^2 / \lambda \quad (8a)$$

which wherein γ is a parameter depending on geometry of the system including the phase pattern of the voltage applied to electrodes.

In fact, eqs. (8) and (8a) underestimate the scaling at higher voltages. This is due to the fact the ohmic conductivity σ rises stronger then thermal conductivity λ:

$$\sigma(\partial T) = \sigma_0 (1 + \alpha \partial T) \quad \alpha \sim 0.022/\mathrm{K}$$

$$\lambda(\partial T) = \lambda_0 (1 + \beta \partial T) \quad \beta \sim 0.002/\mathrm{K} \quad (9)$$

Taking eq. (9) into account, eq. (8a) results in:

$$\partial T(U) = \gamma \sigma_0 / \lambda_0 U^2 (1 + \Gamma \sigma_0 / \lambda_0 (\alpha - \beta) U^2 + O(U^4)) \quad (10)$$

Although eq. 10 is only strictly true for homogenous systems, it gives a good estimate for sandwich systems as well.

Based on the above, the object of the invention is to provide a highly efficient and low cost device and method for the manipulation of particles that allow reduction of overall diagnostic time and risk of contamination.

BRIEF SUMMARY OF THE INVENTION

The term "particle" used in the context of the invention is used in a general sense; it is not limited to individual biological cells. Instead, this term also includes generally synthetic or biological particles. Particular advantages result if the particles include biological materials, i.e. for example biological cells, cell groups, cell components or biologically relevant macromolecules, if applicable in combination with other biological particles or synthetic carrier particles. Synthetic particles can include solid particles, liquid particles or multiphase particles which are delimited from the suspension medium, which particles constitute a separate phase in relation to the suspension medium, i.e. the carrier liquid.

In particular, the invention is advantageously applicable for biological particles, especially for integrated cell separation, lysis and amplification from blood or other cell suspensions.

According to the present invention, there are provided a method and a device for the treatment of biological samples, as defined in claims 1 and 28, respectively.

BRIEF SUMMARY OF THE DRAWINGS

For the understanding of the present invention, a preferred embodiment is now described, purely as a non-limiting example, with reference to the enclosed drawings, wherein.

DETAILED DESCRIPTION OF THE INVENTION

Figure 1:
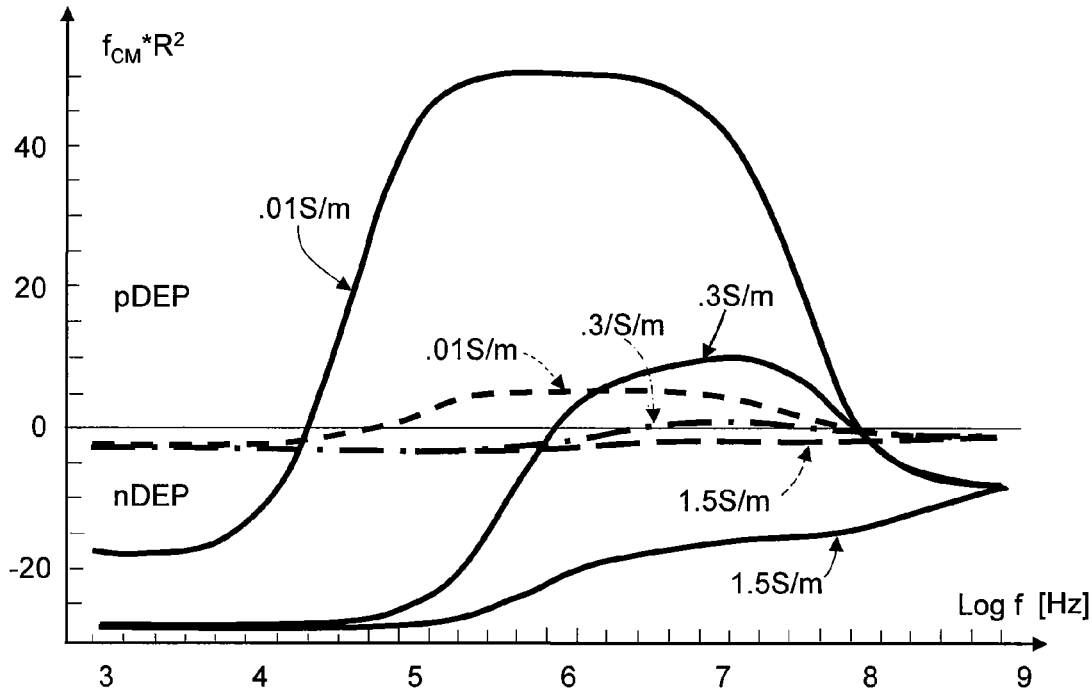
FIG. 1 illustrates the relative dielectrophoretic force for lymphocytes and erythrocytes, at three different medium conductivities.
Figure 2:
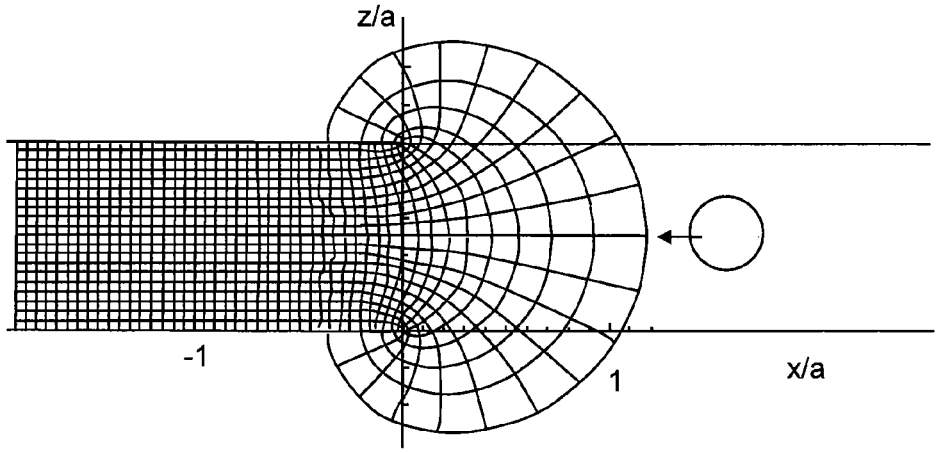
FIG. 2 shows a cross-section of an electrode pair of a capacitor and the existing electrical field.

According to one embodiment of the invention, a plurality of planar electrodes in a microchannel are used for separation, lysis and amplification in a chip. Cells from a sample are brought to a first group or array of electrodes. Depending on sample properties, phase pattern, frequency and voltage of the first array of electrodes and flow velocity are chosen to repel/trap target cells (for example, white blood cells or bacteria) using nDEP in regions of low electric field in the fluid between the first group of electrodes and their counterelectrodes, whereas majority of unwanted cells flush through. In the alternative, pDEP is used to trap the target cells near the electrodes. Separation of red blood cells and white blood cells is comparatively easy because the larger white blood cells experience larger relative DEP forces (DEP force versus hydrodynamic force).

During or after separation, target cells are trapped at the same or a second group of electrodes. This can be achieved by switching the frequency of the first group of electrodes to a frequency of pDEP (e.g. from kHz range to lower MHz range for modeled lymphocytes) or switching off the first group of electrodes whilst the second group of electrodes is energized for pDEP. Dielectric properties of the trapped cells can be changed by RF and/or thermal or chemical lysis. The changed cells can be further manipulated (separation/trapping) by nDEP or pDEP at a second group of electrodes.

In a further alternative embodiment, the unwanted cells are first trapped or deflected by pDEP or nDEP using a first electrode array biased at a frequency while the target cells are flushed through. The target cells are then trapped and treated as described above using the same frequency or another frequency on a second electrode array.

To minimize clogging, the electrodes of an array or group can be driven according to predefined (depending on flow velocity) or feedback-controlled time regime such that the groups of electrodes are filled with target cells sequentially. This can be achieved by first switching on the electrodes that are the furthest from the device input (most downstream electrodes). Then, when these electrodes are filled, the electrodes that are immediately upstream are energized, and so on. Here, passivated electrodes with small openings in the passivating layer can be used.

The trapped particles are then lysed to release the information carriers contained therein. The term "information carrier" employed in the context of the invention is used in a general sense, it is not limited to RNA and DNA, it also includes proteins or modified oligonucleotides.

Electric field mediated cell lysis is based on induction of an additional transmembrane potential (TMP) which oscillates with the external field. Its absolute value is approximately given by:

$$TMP(\omega, \theta) = 1.5E\,R\cos(\theta)\left|\frac{1}{1+i\omega\tau}\right| \tag{11}$$

with a time constant $\tau$ mainly depending on membrane capacity $\tau \sim \in_m/d$. It drops sharply with frequency ($\omega=2\pi f$) and is superimposed to the permanent transmembrane potential (pTMP) of about 100 mV resulting from cell charging. When the transmembrane potential exceeds values of about 1 V, membrane breakdown occurs. This results in an increase of membrane conductivity and subsequently change of cell interior. As a consequence, cells originally showing nDEP behaviour are attracted to the electrodes of the same or second group of electrodes. Additionally, the cells can be further lysed either by RF fields or thermally (higher field values near electrodes) or using additional DC high voltage pulses.

Particles can be considered as dielectric bodies consisting of different layers with different electrical properties (Fuhr, G., Müller, T., Hagedorn, R., 1989. Reversible and irreversible rotating field-induced membrane modifications. *Biochim. Biophys. Acta* 980: 1-8). Thus it is possible to lyse first the nuclear membrane with higher frequencies, and then the outer cell membrane.

In general, particles can be considered as homogeneous spheres, single- or multi-shell models. For example, a cell with cell nucleus can be considered as 3-shell model, wherein the first layer is the outer membrane, the second layer is cytoplasm, the third layer is the nuclear membrane, and the three layers surround the nuclear body. The electrical loading of the outer membrane decreases with increasing field frequency. In contrast to the behaviour of the outer membrane, the electrical loading of the inner membrane is low at lower frequencies, increases with rising frequencies and decreases again at high frequencies (see Fuhr, G., Müller, T., Hagedorn, R., 1989. Reversible and irreversible rotating field-induced membrane modifications. *Biochim. Biophys. Acta* 980: 1-8, FIG. 3). The dielectric properties (permittivity, conductivity and thickness) of each layer determines the value of the induced transmembrane potentials. Increasing the conductivity of the outer membrane increases the height of the induced transmembrane potential of the inner membrane.

After lysis, the information carriers are separated from the unwanted lysis products e.g. by flow and dielectrophoresis. In particular, the information carriers are transported to an amplification (PCR) region and/or amplification (PCR) reagents are brought to the electrodes holding the information carriers so as to amplify them. Thermocycling is done using buried elements or using the same trapping electrodes, applying appropriate voltages to realize the required temperature sequences. Beside simplicity, the latter solution has the advantage of faster ramps (down to ms) due to very small heated volumes.

In a further embodiment, the products of amplification can be analysed at a further electrode array e.g. by electric analysis of binding processes of analytes onto specially prepared electrodes. Suitable preparation of electrodes (e.g. coating of gold electrodes by stable organic compounds and further immobilization of biomolecules e.g. DNA or RNA probes) is state of the art and compatible with CMOS technology, see e.g. Hoffman et al., (imec.be/essderc/ESSDERC2002/PDFs/D24_3.pdf).

The binding process can be detected by impedance measurements that have been shown to be sensitive enough to detect molecular events (Karolis et al., Biochimica et Biophysica Acta, 1368, 247-255, 1998). In this way separation, lysis, amplification and detection can be carried out in a simple chip having only fluidic and electric connections, thus reducing cost and time for analysis.

Alternatively, direct analyte detection can be carried out using voltmetric or amperiometric methods (see e.g. Hoffmann et al. or Bard & Fan, *Acc. Chem. Res.* 1996, 29, 572-578) not requiring surface coating of electrodes. In this case, the same electrodes as used for trapping and or lysis can be used.

Experiments revealed that RF lysed cells remain stably trapped at the electrodes after switching off the field. DC pulses can afterwards be used for additional lysis but also to remove the lysis products if PCR is carried out further downstream. Compared to DC pulses, RF fields have the advantage of minimizing (avoiding) electrochemical reactions at the electrodes (e.g. electrolysis). Further, they better penetrate the cell interior. This is of importance since not only the cell membrane but also the membrane of the nucleus has to be disintegrated. PCR with RF lysed cells was successful without additional DC pulses allowing simplification of electronics and shielding.

Figure 3:
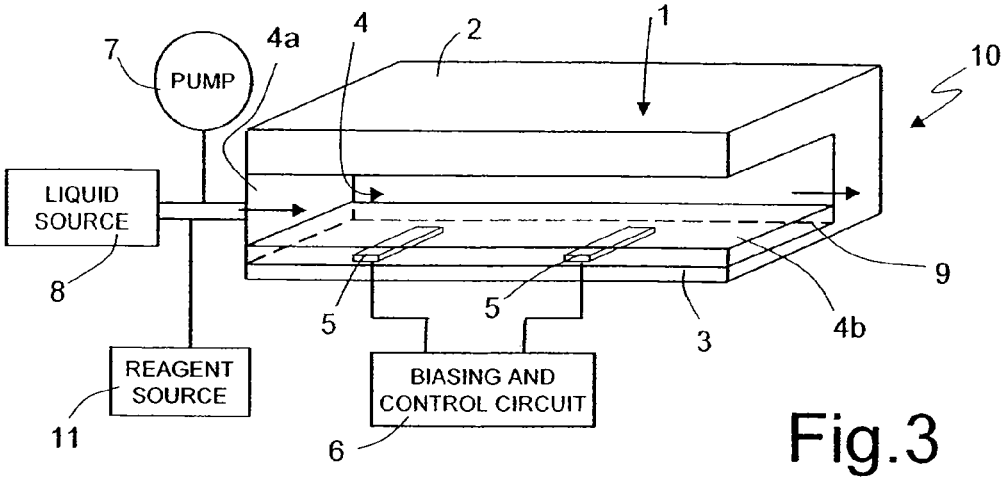
FIG. 3 shows a cross-section of a device for performing treatment of biological samples, according to a first embodiment of the present invention.
Figure 4:
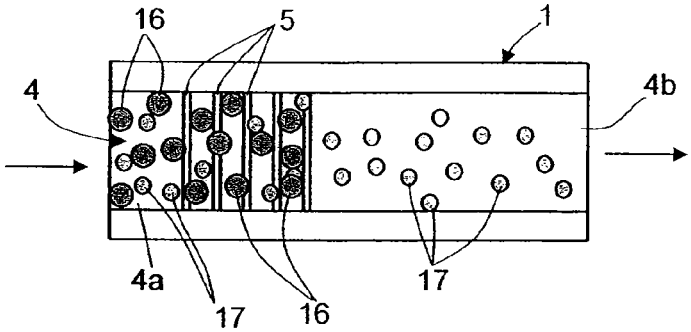
FIG. 4 shows a top plan view of the device of FIG. 3.

FIGS. 3 and 4 show an implementation of a device 10 intended to treat biological samples including mixture of target particles and other particles. In particular, the device 10 of FIGS. 3 and 4 is suitable for separating and amplifying white blood cells, but may also be used for selecting and treating red blood cells (e.g. for detecting special diseases, e.g. malaria, or for carrying out prenatal diagnostic purposes) or for detecting migrating tumor cells or bacteria.

The device 10 of FIGS. 3 and 4 is formed in a chip, e.g. of silicon or glass, comprising a body 1 having a first wall 2 and a second wall 3 enclosing a main channel 4 filled by a liquid injected from an inlet 4*a* of the channel and including both target cells and unwanted cells (waste). The channel 4 has also an outlet 4*b* for discharging the unwanted cells as well as the target cells, at the end of the treatment.

Electrodes 5 are formed on the second wall 3 and are connected to a biasing and control circuit 6, shown only schematically, for applying electric pulses to the electrodes 5 and possibly for detection purposes. The electrodes are biased by applying a single or double-phase RF voltage. If the chip comprising the body 1 is of silicon, the biasing and control circuit 6 may be integrated in the same chip. The electrodes 5 are planar electrodes formed by straight metal elements, that are arranged here parallel to each other and perpendicular to the channel 4, and are generally covered by a passivation layer 9. In the alternative, the electrodes 5 may be formed by blank electrode strips.

The body 1 is connected to a pump 7, here shown upstream of the channel 4, for injecting the liquid to be treated from a liquid source 8 into the inlet 4*a* of the channel 4. Furthermore, a reagent source 11 is also connected to the inlet 4*a* of the channel 4 for injections of reagents during PCR. In the alternative, the pump 7 could be connected to the outlet 4*b* to suck the liquid and the reagents out of the respective sources 8, 11, after passing through the channel 4 and being treated therein. In this case, a valve structure may be needed between the reagent source 11 and inlet 4*a* to control injection.

In any case, the liquid that flows through the channel 4 is subject to a hydrodynamic force, represented here by arrows, drawing the liquid from the inlet 4*a* towards the outlet 4*b*. The pump 7 may be integrated in a single chip as body 1, e.g. as taught in EP-A-1 403 383.

With reference to FIGS. 3 and 4, a liquid (e.g., 1-10 μl) comprising a mixture of target cells (16 in FIG. 4) and undesired cells (17 in FIG. 4) is injected into the channel 4 from the liquid source 8 through the inlet 4*a*. The electrodes 5 are biased so that each electrode is in counterphase with respect to the adjacent electrodes. For example, the electrodes are biased by applying an AC voltage with an amplitude of 1-10 V and a frequency of between 300 KHz and 10 MHz. pDEP or nDEP may be used. If pDEP is used, the target cells 16 are attracted to the electrodes 5, while the unwanted cells 17 are washed out through the outlet 4*b*. If nDEP is used, the target cells 16 are repelled from the electrodes 5 toward the first wall 2.

Then, the target cells 16 are lysed, either electrically (through application of a DC field or an RF field), chemically or biochemically (through introduction of a lysis reagent), and/or thermally. DC lysis may performed by applying pulses having amplitude of 20-200 V, width of 5-100 μs, and a repetition frequency of 0.1-10 Hz for 1-60 s. AC lysis may performed by applying an AC voltage having amplitude of 3-20V and a frequency of between 10 kHz and 100 MHz. Chemical or biochemical lysis may be performed using known protocols. Thermal lysis may be performed at 45-70° C. Lysis can also be monitored using a fluorescent marker e.g. calcein.

Then, with the lysed target cells 16 trapped against the same trapping electrodes 5 or subsequent suitably biased electrodes 5 arranged downstream of the trapping electrodes, PCR is brought about by introducing a reagent liquid (including polymerase) and carrying out a thermal cycle (thermocyclying) so as to amplify the released information carriers (DNA, RNA or proteins).

The electrodes 5 can be used also for detection, using voltmetric or amperiometric methods. In this case, the biasing and control circuit 6 also comprises the components necessary for generating the needed test currents/voltages and the measuring components and software.

Figure 5:
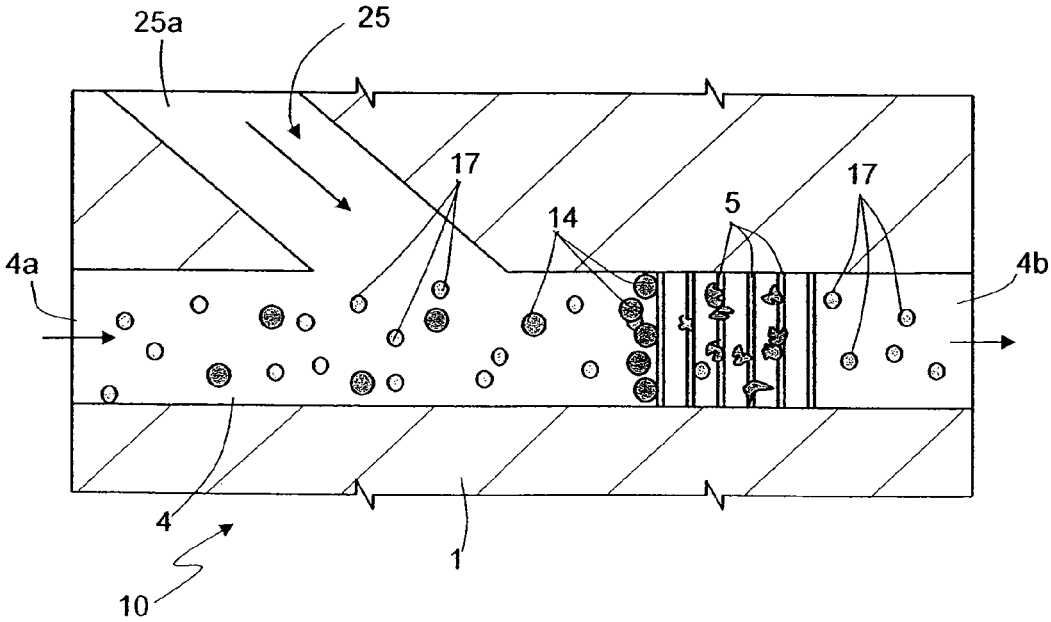
FIG. 5 shows a top plan view of a second embodiment of the present device.

FIG. 5 shows the top view of another embodiment of the device 10 wherein a reagent channel 25 having an inlet 25*a* is formed directly in the body 1, to allow injection of the reagents for chemical lysis and/or PCR. Otherwise, the device 10 of FIG. 5 is the same as of FIGS. 3 and 4.

Figure 6:
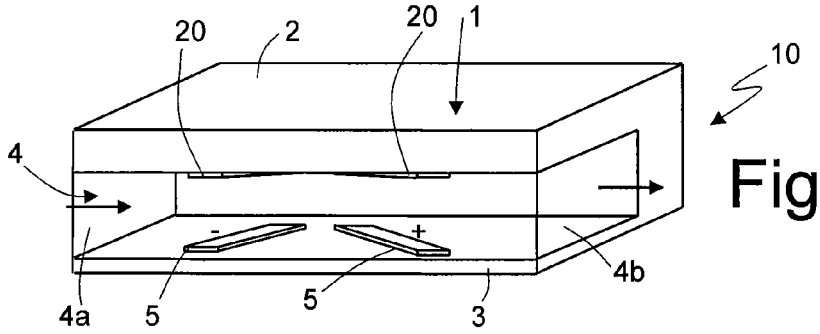
FIG. 6 shows a cross-section of a different device, according to a third embodiment of the present invention.
Figure 7:
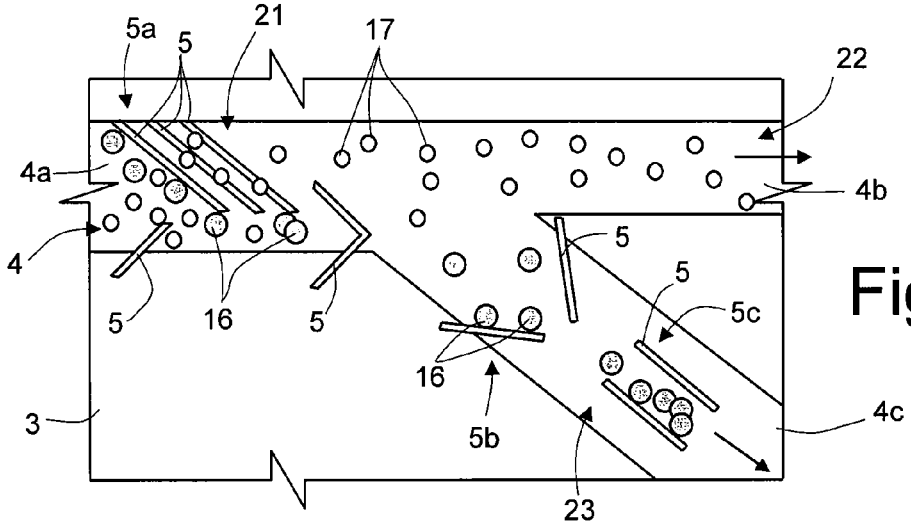
FIG. 7 shows a top plan view of the device of FIG. 6.

FIGS. 6 and 7 refer to a different embodiment of the device 10, wherein the channel 4 has a deflection portion 21 connected to the inlet 4*a* and two branch portions, including a waste branch portion 22 and a lysis/amplification portion 23. Waste branch portion 22 extends between the deflection portion 21 and a first outlet 4*b*, and lysis/amplification portion 23 extends between the deflection portion 21 and a second outlet 4*c*.

The electrodes 5 are formed on the second wall 3 of the body 1, while a group of counterelectrodes 20 is formed on the first wall 2, opposite the electrodes 5. Each counterelectrode 20 faces a respective electrode 5. The electrodes 5 can be individually biased by the control circuit 6, while the counterelectrodes 20 are generally interconnected and left floating or grounded.

In the embodiment shown in FIGS. 6 and 7, the electrodes 5 and counterelectrodes 20 are arranged along the deflection portion 21 and the lysis/amplification portion 23, transversely thereto. Since the layout of the counterelectrodes 20 is the same as for the electrodes 5, reference will be made hereinafter only to the electrodes 5.

For example, here the electrodes 5 include three groups of electrodes 5*a*, 5*b* and 5*c*. First electrodes 5*a* are arranged in two sets, parallel to each other and transversely to the channel 4, to form V shapes (hook-like structures), so as to increase the trapping capability. Second electrodes 5*b* are arranged in the shape of a V along the beginning of the lysis/amplification portion 23. Third electrodes 5*c* are arranged in the lysis/amplification portion 23, downstream of the second electrodes 5*b*, and are parallel to each other and to the lysis/amplification portion 23.

The electrodes 5 and the counterelectrodes 20 are generally covered by a passivation layer, not shown here for sake of clarity and better described with reference to FIGS. 9-11.

Also here, the liquid including the mixture of target and the unwanted cells is injected into the channel 4 through the inlet 4*a*. The target cells 16 are separated from the unwanted cells 16 in the deflection portion 21 and collected, e.g., between the counterelectrodes 20 and the V-shaped first and second electrodes 5*a*, 5*b*, by nDEP, while the unwanted cells 17 are washed out toward the first outlet 4*b* through the waste branch portion 22. The target cells 16 are then released toward the lysis/amplification portion 23, where they are lysed and amplified.

Figure 8:
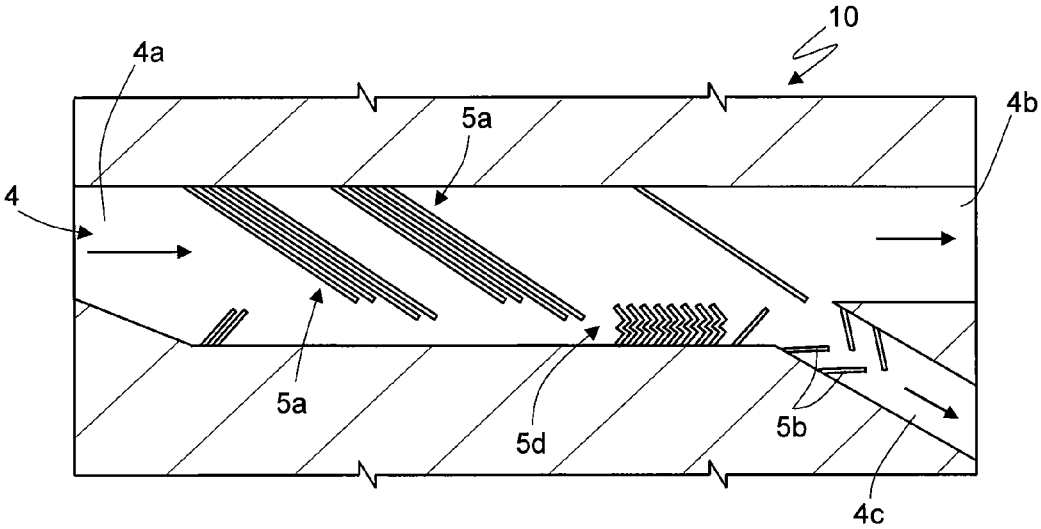
FIG. 8 shows a top plan view of a fourth embodiment of the present device.

FIG. 8 shows a device 10 similar to device 10 of FIG. 7, but including fourth electrodes 5*d* having a zigzag shape in the deflection portion 21, downstream of the first electrodes 5*a*.

Figure 9:
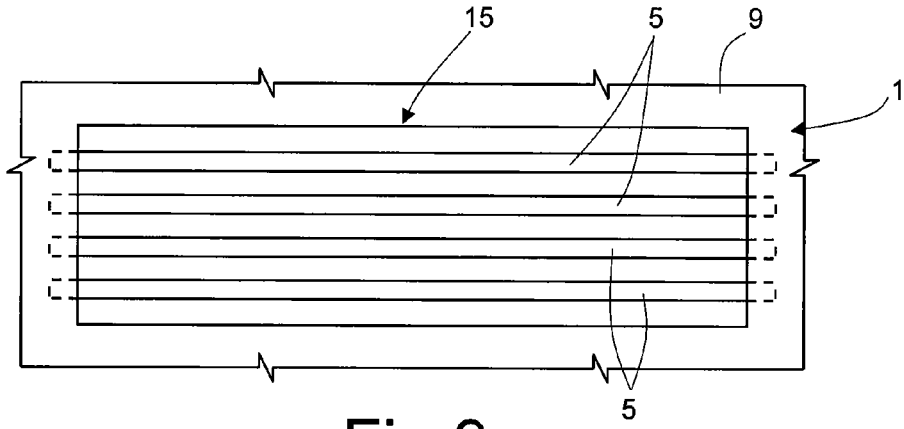
FIGS. 9-11 are top views of alternative layouts of details of the devices of FIGS. 3-8.

FIG. 9 is a top view of a portion of the channel 4, showing a first layout of the electrodes 5. Here, the electrodes 5 are formed by blank straight metal strips and the passivation layer 9 has an opening 15 just over the electrodes 5. Here, during trapping by pDEP, the target cells 16 are attracted to the regions of high field, at the electrode edges.

Figure 10:
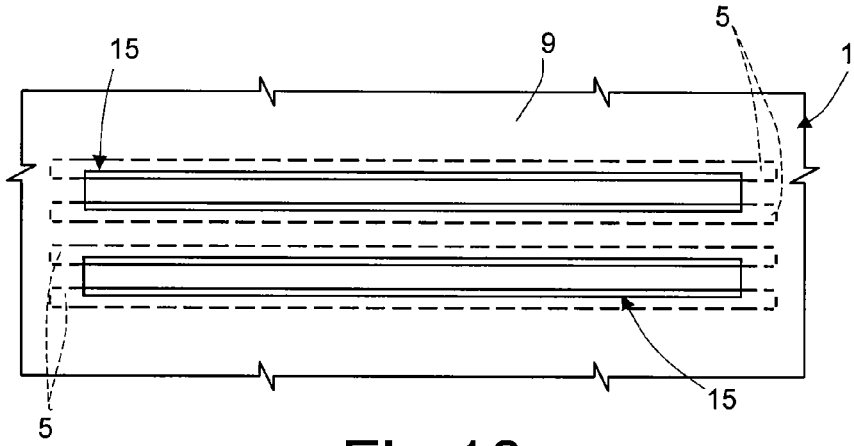

In the embodiment of FIG. 10, the passivation layer 9 has a plurality of openings 15 stretching between and partly on top of two contiguous electrodes 5, so that the passivation 9 does not cover the two facing halves of pairs of electrodes 5. In this case, during trapping by pDEP, the target cells 16 are attracted to the electrode edges that are not covered by the passivation (at the openings 15).

Figure 11:
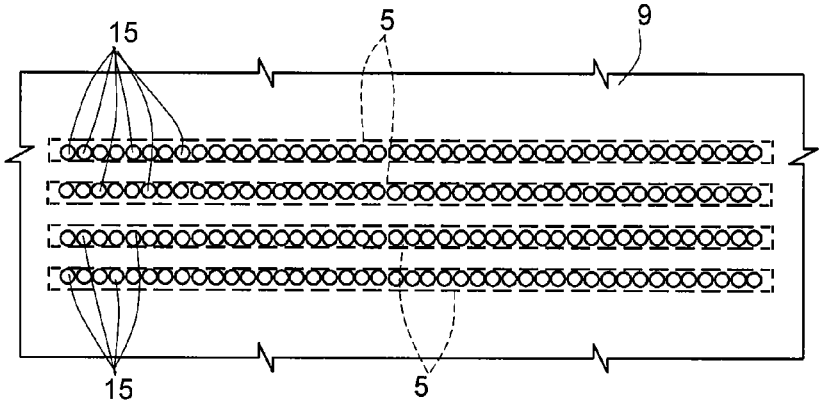

In the embodiment of FIG. 11, the openings 15 in the passivation layer 9 have circular shape and extend along each electrode 5, near two facing edges of pairs of electrodes 5.

Figure 12:
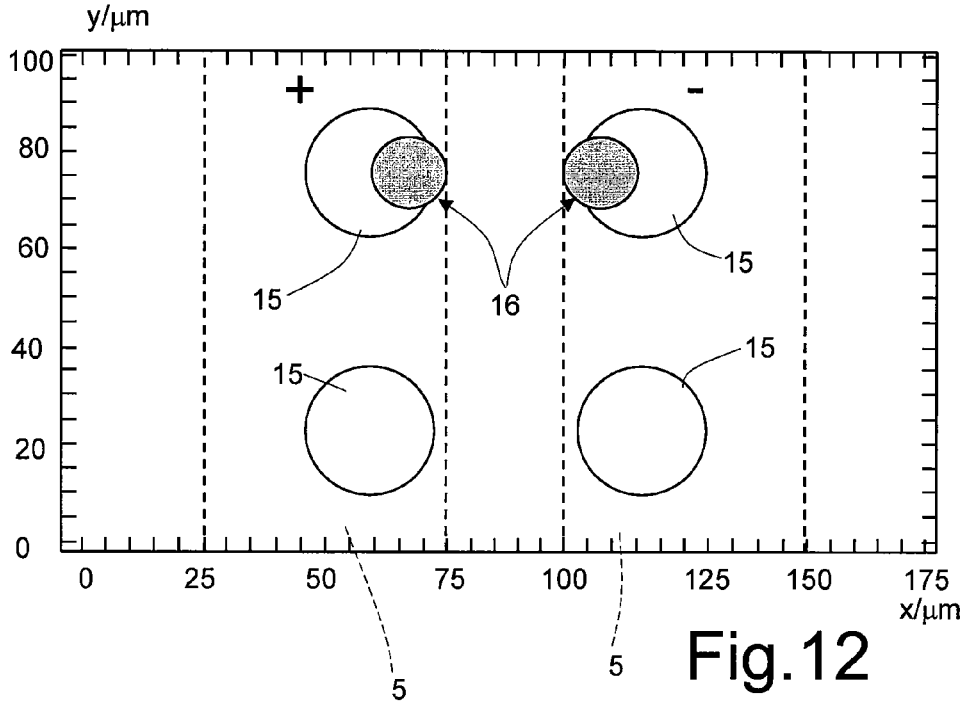
FIGS. 12 and 13 are a top view and a cross-section of a detail of FIG. 11, during a separation step.
Figure 13:
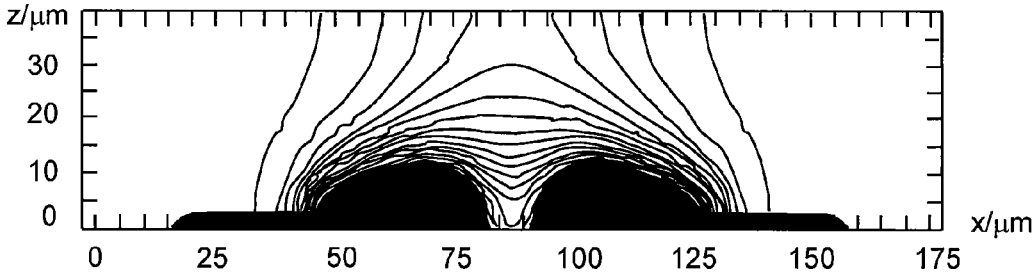

Here, as shown in the enlarged detail of FIG. 12, during trapping by pDEP, the target cells 16 are attracted at the small openings 15, where the field is maximum, as visible from FIG. 13, showing the plot of the mean square electric field distribution.

The use of circular openings 15 in the passivation layer 9 is advantageous because it allows reduced overall sample loss and heating. Furthermore, the openings 15 of small dimensions reduce the risk of clogging, because only few particles are trapped at each hole.

Figure 14A:
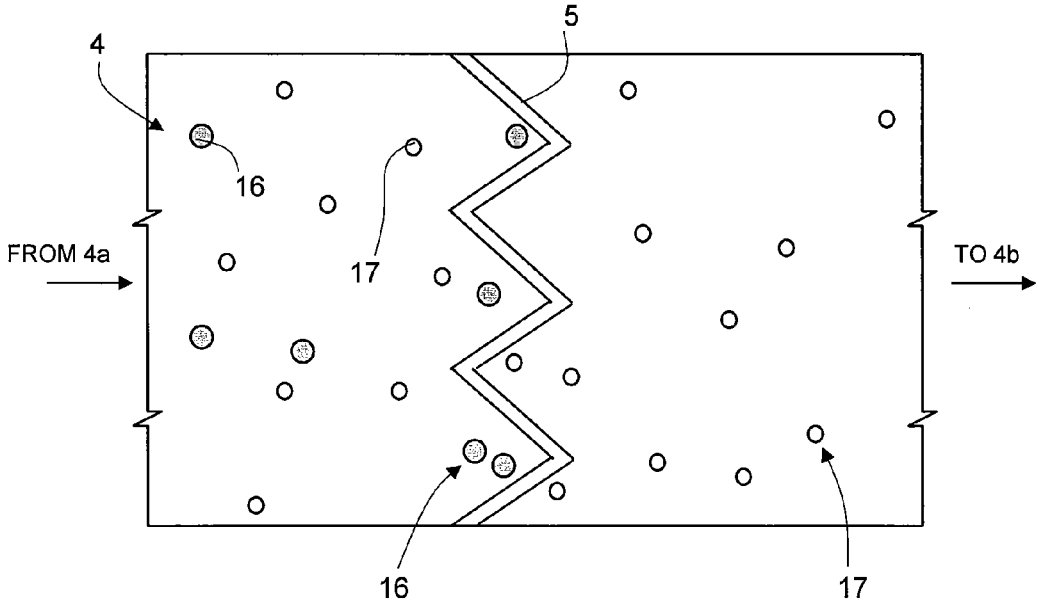
FIG. 14*a* is a top view of a further embodiment of the present device.
Figure 14B:
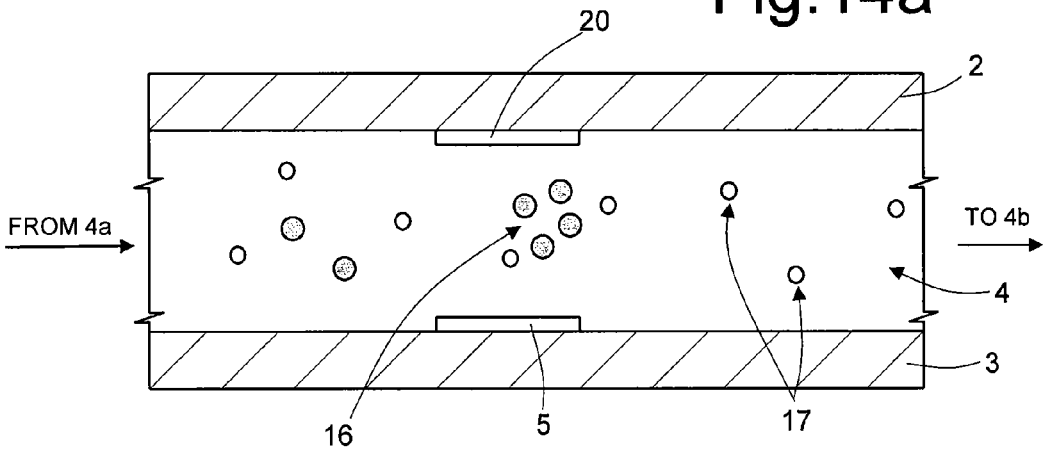
FIGS. 14*b* and 14*c* are cross sections of the device of FIG. 14*a*, at two subsequent times.
Figure 14C:
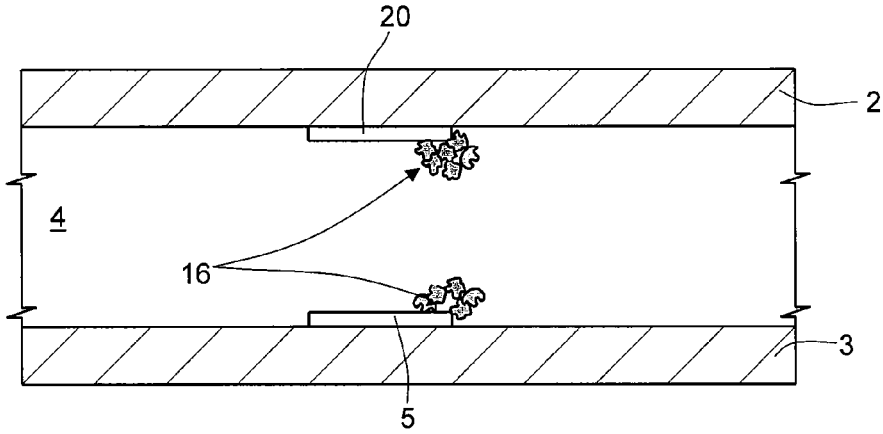

FIGS. 14*a*-14*c* shows another embodiment, wherein the device 10 includes electrodes 5 arranged on first wall 3 and counterelectrodes 20 arranged on second wall 2 of the device 10. The electrodes 5 and the counterelectrodes 20 are zigzag-shaped and are arranged facing each other. As shown in the top view of FIG. 14*a* and in the cross-section of FIG. 14*b*, first the target cells 16 (here, white blood cells) are retarded and trapped by nDEP in the space between electrodes 5 and counterelectrodes 20, while the unwanted cells 17 (here, red blood cells 17) flow through, towards the outlet 4*b*. Then in FIG. 14*c*, the target cells 16 are lysed and change their behavior to pDEP. Thus, they are attracted by both the electrodes 5 and the counterelectrodes 20, where they can be further lysed and subjected to PCR.

Figure 20:
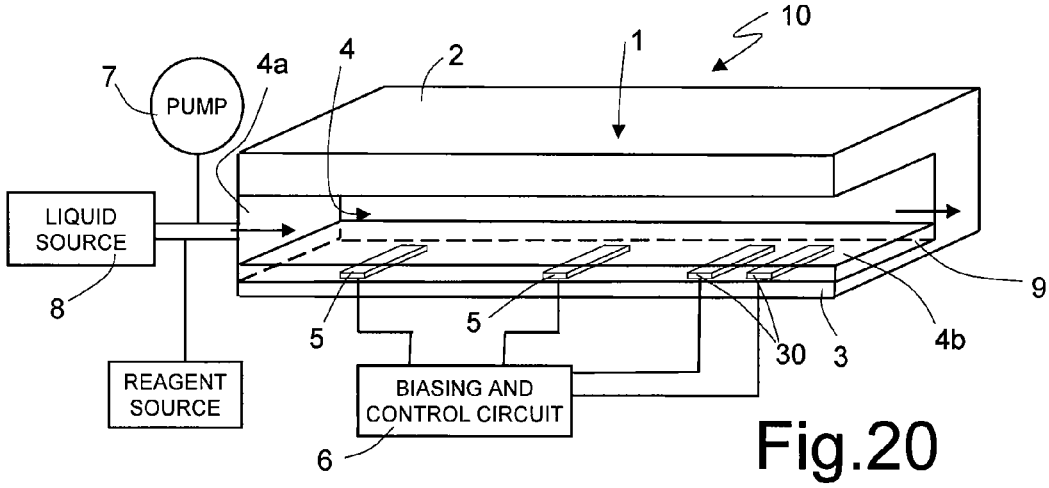
FIG. 20 shows a cross-section of a different embodiment of the present invention.

FIG. 20 shows an embodiment similar to the one of FIG. 3, wherein an array of detection electrodes 30 is formed in a different portion of the device 10. The electrodes 30 cooperate with biasing and control circuit 6 to perform an electric analysis of binding processes of analytes onto specially prepared electrodes. To this end, the detection electrodes 30 are suitably prepared, e.g. gold electrodes are coated with stable organic compounds, wherein biomolecules, e.g. DNA or RNA probes, have been immobilized, as known in the art. The binding process can be detected by impedance measurements performed through the biasing and control circuit 6. In this way separation, lysis, amplification and detection can be carried out in a simple chip having only fluidic and electric connections, thus reducing cost and time for analysis.

The devices 10 of FIGS. 3-20 may be advantageously used to separate and detect white blood cells, as discussed in the examples given below.

EXAMPLE 1

Figure 15:
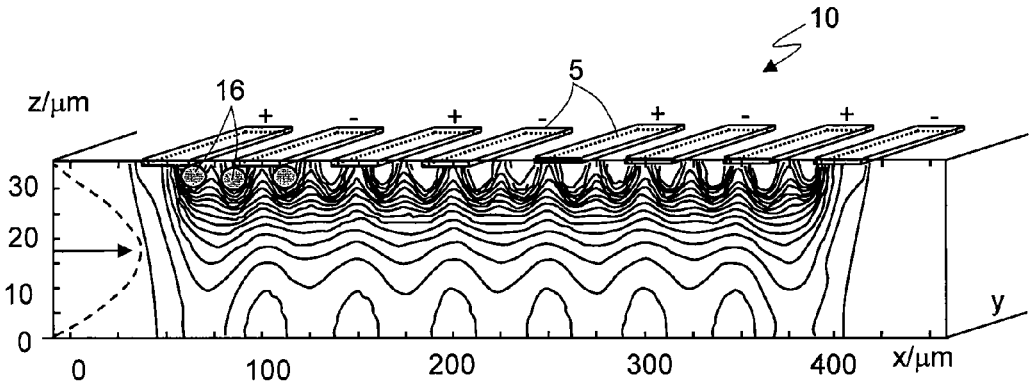
FIG. 15 shows a three-dimensional simulation of the electric field applied to the device of FIG. 3 in a first working condition.

The device 10 of FIGS. 3 and 4 was used for separating white blood cells using pDEP conditions. To this end, a diluted blood liquid (1:200, with a conductivity adjusted to 0.12 S/m) was injected in the inlet 4*a* at a flow rate of 6 nl/s. The electrodes were biased at an AC voltage having an amplitude of 8.5 V and a frequency of 5 MHz. Each electrode 5 was biased in counterphase with respect to the adjacent electrodes. White blood cells 16 were trapped at the electrodes 5, while red blood cells 17 passed to the outlet 4*b* almost unaffected, as visible from FIG. 15 showing a simulation of the electric field in a test device 10. In FIG. 15, the device was drawn upside down with gravity g acting from below.

Figure 16:
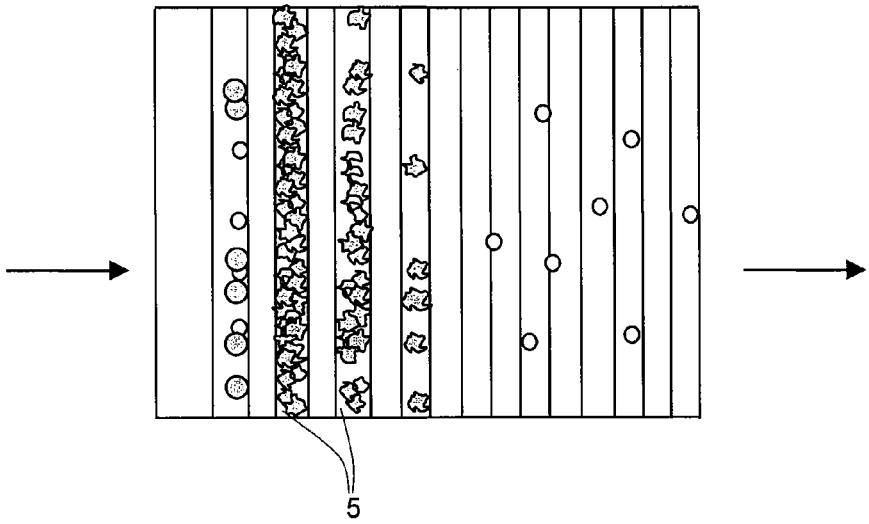
FIG. 16 shows the result of the separation and lysis treatment in the device of FIG. 15.

Then the trapped blood cells were electrically lysed by applying DC pulses (with amplitude 131 V, duration 20 μs and repetition frequency of 0.5 Hz). FIG. 16 shows the trapping of lysed white blood cells 16.

Next PCR reagents were introduced in the device 10 and temperature cycles were applied. In particular, the PCR reagents are shown in Table 1, and the temperature cycles included a pre-denaturation cycle at 94° C. for 3 m; twelve cycles including denaturation at 94° C. for 40 s, annealing at 58° C. for 42 s, and extension at 72° C. for 45 s; then twenty-three cycles including denaturation at 94° C. for 40 s, annealing at 46° C. for 40 s, and extension at 72° C. for 45 s.

TABLE 1

Preparation of PCR master mix to be added to 1 μl sample

| | Master Mix |
|---|---|
| Pure water | 10 μl |
| Sigma 2× Mix* | 15 μl |
| Primer 1** | 1.5 μl |
| Primer 2 | 1.5 μl |
| Total Volume | 28 μl |

*Sigma Extract-N-Amp ™ Blood PCR Kit (Sigma ™ cat. No XNAB2R Lot 91K9295)
**Primers (MLH-1, 3' and 5' primer, Evotec Technologies ™)

The results are not shown, but successful cell separation, lysis and amplification was achieved.

EXAMPLE 2

The device 10 of FIGS. 3 and 4 was used for separating white blood cells using nDEP conditions for white blood cells. To this end, a diluted blood liquid having the same composition as in the first test was injected in a device 10, wherein the electrodes were biased at A=8.5 V, f=320 MHz.

Figure 17:
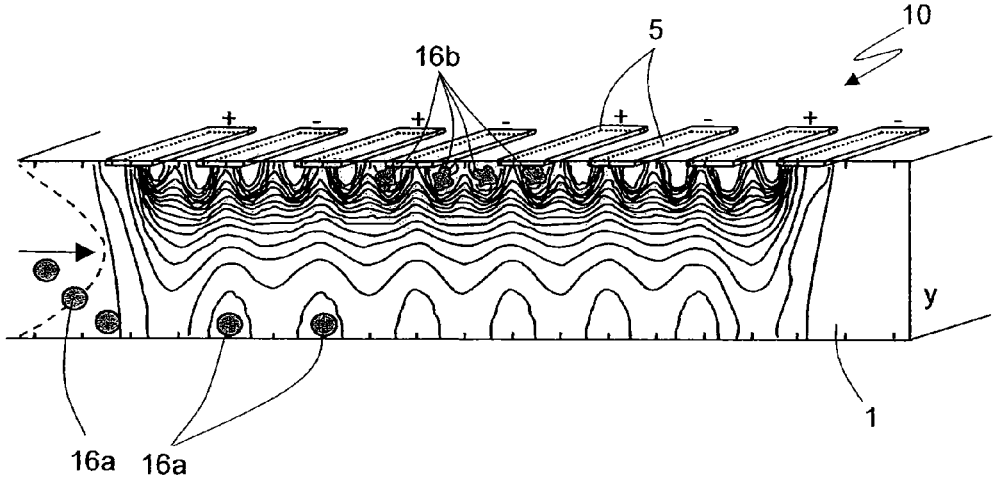
FIG. 17 shows a three-dimensional simulation of the electric field applied to the device of FIG. 3 in a second working condition.

White blood cells 16 were trapped at the first wall 2 opposite to electrodes 5, while red blood cells 17 passed to the outlet 4*b* almost unaffected, as visible from FIG. 17, showing an upside down device 10, wherein white cells 16*a* are shown trapped in minimum field position.

Figure 18:
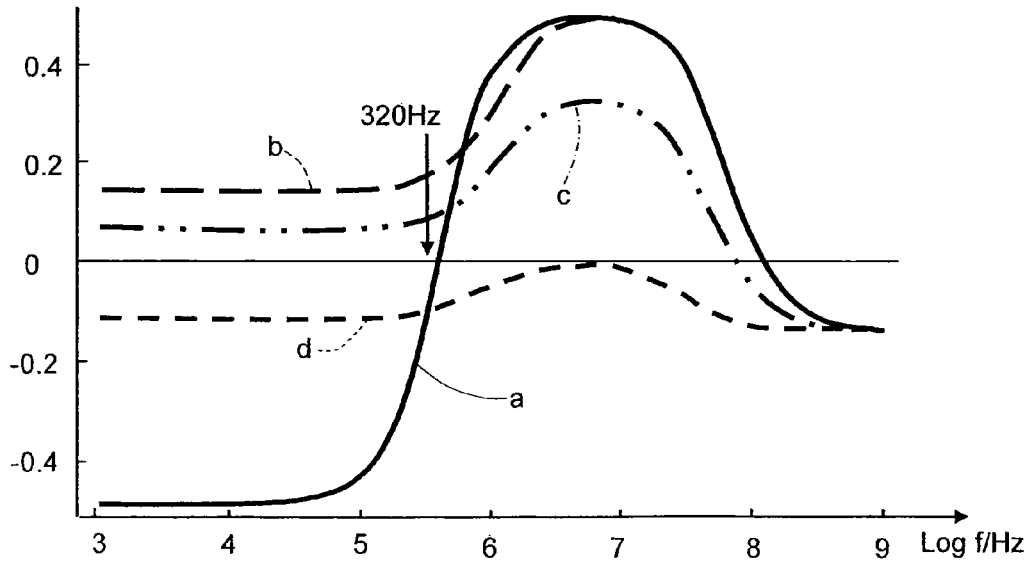
FIG. 18 is a plot of electrical quantities for the device of FIG. 17.
Figure 19A:
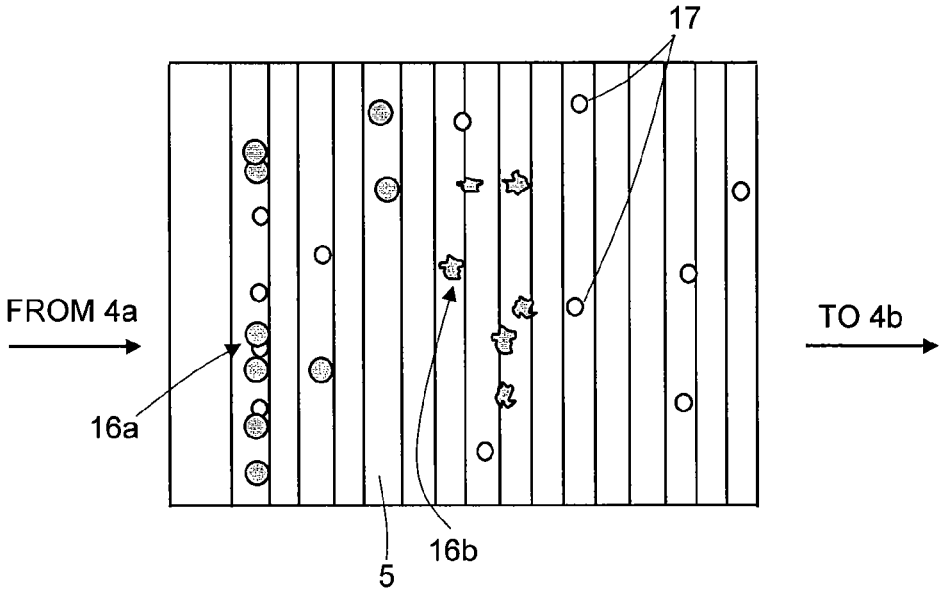
FIGS. 19*a* and 19*b* are top views of the device of FIG. 17, showing the behavior of particles during separation and lysis, at two subsequent times.
Figure 19B:
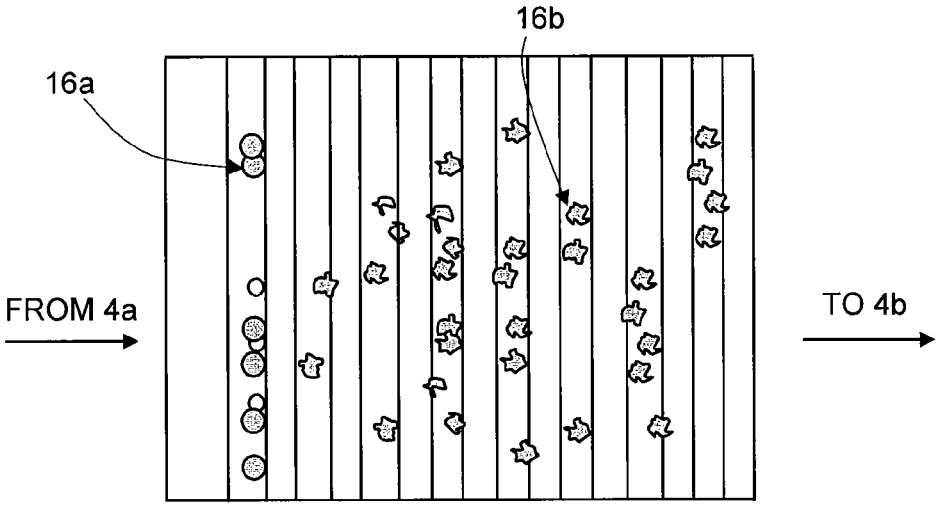

Then, the trapped white blood cells were electrically lysed by applying an RF voltage to a second group of electrodes 5 (A=11 V, f=320 kHz). In particular, during this phase, a change of dielectrophoretic behaviour of the white blood cells was observed. In fact lysis was accompanied by an increase of membrane conductivity resulting in a change from nDEP (curve a in FIG. 18, showing the plot of the dielectrophoretic force as a function of the frequency of white blood cells) to pDEP behaviour (curve b) at moderate external conductivity (about 0.1 S/m). Then ion leakage decreasing internal conductivity was observed (curves c and d in FIG. 18). Trapping and lysis of white blood cells 16 is also visible from FIG. 19*a*, 19*b*, which illustrate the device viewed through a transparent upper wall 2 at two subsequent times and showing first nDEP (cells 16*a*) and then pDEP trapping (cells 16*b*).

Thereafter, the lysed cells were subject to amplification as discussed in example 1. Results are not shown, but successful amplification was achieved.

The advantages of the present invention are clear from the above. In particular, implementation of a single microdevice for particle separation, lysis and amplification allows reduction of the overall diagnostic time and risk of contamination. Furthermore, samples of smaller volumes can be used, thus further reducing the diagnostic costs, and the risk of sample loss due to fluid transfer needs is eliminated.

Finally, it is clear that numerous variations and modifications may be made to the device and process described and illustrated herein, all falling within the scope of the invention as defined in the attached claims.

What is claimed is:

1. A method for the treatment of biological samples in a device including a body having a channel delimited by a first and a second wall facing each other and at least one first electrode formed on the second wall, the method comprising the steps of:

a) introducing a liquid into said channel, said liquid including first and second particles having different dielectrophoretic (DEP) behavior under the same conditions;

b) generating an AC field within said body by biasing the first electrode;

c) separating said first particles from said second particles at said first electrode based on said different DEP behaviour of the first and the second particles in said AC field;

d) trapping said first particles at said first electrode;

e) lysing said trapped first particles at said first electrode to release information carriers contained in said first particles; and f) amplifying said information carriers, wherein said separating, trapping, and lysing each occur at the same group of electrodes.

2. The method of claim 1, wherein the step of amplifying the information carriers comprises performing a polymerase chain reaction (PCR) treatment.

3. The method of claim 1, wherein said biasing comprises applying a voltage causing attraction of said first particles against said first electrode.

4. The method of claim 1, wherein said first wall has at least one counterelectrode arranged facing said first electrode, wherein said step of trapping further comprises biasing said counterelectrode to cause said first particles to be repelled also from said counterelectrode and to be trapped in a space between said first electrode and said counterelectrode, said lysing being carried out while said first particles are trapped in said space.

5. The method of claim 1, wherein said lysing comprises biasing said first electrode sufficient to lyse said first particles.

6. The method of claim 5, wherein said lysing comprises applying an RF voltage to said first electrode so as to cause a change of the DEP behavior of the trapped first particles.

7. The method of claim 5, wherein said lysing comprises applying a DC pulsed voltage to said first electrode so as to cause a change of the DEP behavior of the trapped first particles.

8. The method of claim 1, wherein said lysing is carried out thermally or chemically.

9. The method of claim 1, wherein said amplifying comprises thermocycling using said first electrode.

10. The method of claim 1, wherein said AC field has a first frequency and a first amplitude during said separating step, and a first frequency and a second amplitude, different from said first amplitude, during said trapping step.

11. The method of claim 1, wherein said AC field has a first frequency and a first amplitude during said separating step, and said AC field has a second frequency and a first amplitude, different from said first frequency, during said trapping step.

12. The method of claim 1, wherein said AC field has a first frequency and a first amplitude during said separating step, and said AC field has a second frequency and a second amplitude, different from said first amplitude and said first frequency, during said trapping step.

13. A device for the treatment of biological samples, comprising a body having:

a channel having a first wall and second wall facing each other;

an inlet for introducing a liquid in the channel;

at least one electrode on said second wall;

means for AC biasing said one electrode thereby allowing separation and trapping of the target particles in said liquid in the channel based on differential dielectrophoresis behaviour;

means for lysing the target particles as trapped in said channel and releasing information carriers contained in said target particles; and means for amplifying the information carriers in the channel, wherein said separation, trapping, and lysing occur at the same group of electrodes.

14. The device of claim 13, wherein said first wall has at least one counterelectrode arranged facing said electrode.

15. The device of claim 13, wherein said electrode is a blank electrode.

16. The device of claim 13, comprising a passivation layer covering said electrode and holes in said passivation layer.

17. The device of claim 13, wherein said electrode is an elongated element and said holes comprise apertures extending along a main edge of said elongated element.

18. The device of claim 13, wherein said electrode is an elongated element and said holes comprise a plurality of circular apertures aligned along a main edge of said elongated element.

19. The device of claim 13, wherein said channel comprises a first and a second inlet.

20. The device of claim 13, wherein said channel comprises a first and a second outlet.

21. The device of claim 13, wherein said body comprises means for detecting the amplified information carriers.

22. The device of claim 21, wherein said means for detecting are impedance detecting means.

23. The device of claim 21, wherein said means for detecting comprises said electrode.

24. The device of claim 21, wherein said means for detecting comprises an array of detection electrodes.

25. The method of claim 1, wherein the particles are cells, the information carriers are nucleic acid, and wherein the step of amplifying the information carriers comprises performing a polymerase chain reaction (PCR) treatment.

* * * * *

UNITED STATES PATENT AND TRADEMARK OFFICE

CERTIFICATE OF CORRECTION

PATENT NO. : 7,988,841 B2
APPLICATION NO. : 11/531679
DATED : August 2, 2011
INVENTOR(S) : Mario Scurati, Torsten Mueller and Thomas Schnelle It is certified that error appears in the above-identified patent and that said Letters Patent is hereby corrected as shown below:

Col. 10, line 63, should read:

1. A method for the treatment of biological samples in a device including a body having a channel delimited by a first and a second wall facing each other and at least one first electrode formed on the second wall, the method comprising the steps of:
a) introducing a liquid into said channel, said liquid including first and second particles having different dielectrophoretic (DEP) behavior under the same conditions;
b) generating an AC field within said body by biasing the first electrode;
c) separating said first particles from said second particles at said first electrode based on said different DEP behaviour of the first and the second particles in said AC field;
d) trapping said first particles at said first electrode;
e) lysing said trapped first particles at said first electrode to release information carriers contained in said first particles; and
f) amplifying said information carriers,
wherein said separating, trapping, and lysing each occur at the same group of electrodes.

Signed and Sealed this
Twenty-seventh Day of September, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,988,841 B2
APPLICATION NO. : 11/531679
DATED : August 2, 2011
INVENTOR(S) : M. Scurati et al.

It is certified that error appears in the above-identified patent and that said Letters Patent is hereby corrected as shown below:

On the title page, item [73]; the Assignee section needs to be corrected to include a second assignee. Thus, it should read:

Assignee: STMicroelectronics S.r.l., Agrate Brianza (IT)
Evotec Technologies GMBH, Dusseldorf (DE)

Signed and Sealed this
Twenty-second Day of January, 2013

David J. Kappos

David J. Kappos
*Director of the United States Patent and Trademark Office*